US012716031B2

(12) United States Patent
Wu et al.

(10) Patent No.: US 12,716,031 B2
(45) Date of Patent: Aug. 25, 2026

(54) SEPARATION AND PROCESSING OF RECYCLED CONTENT PYROLYSIS GAS

(71) Applicant: ExxonMobil Product Solutions Company, Spring, TX (US)

(72) Inventors: Xianchun Wu, Longview, TX (US); Daryl Bitting, Longview, TX (US); Michael Gary Polasek, Longview, TX (US); David Eugene Slivensky, Tatum, TX (US)

(73) Assignee: ExxonMobil Product Solutions Company, Spring, TX (US)

( * ) Notice: Subject to any disclaimer, the term of this patent is extended or adjusted under 35 U.S.C. 154(b) by 206 days.

(21) Appl. No.: 18/567,965

(22) PCT Filed: Jun. 24, 2022

(86) PCT No.: PCT/US2022/034864

§ 371 (c)(1),
(2) Date: Dec. 7, 2023

(87) PCT Pub. No.: WO2023/278264

PCT Pub. Date: Jan. 5, 2023

(65) Prior Publication Data

US 2024/0271044 A1 Aug. 15, 2024

Related U.S. Application Data

(60) Provisional application No. 63/202,913, filed on Jun. 30, 2021.

(51) Int. Cl.
*C10G 1/10* (2006.01)
*C10G 5/00* (2006.01)

(52) U.S. Cl.
CPC ..... *C10G 1/10* (2013.01); *C10G 5/00* (2013.01); *C10G 2300/1003* (2013.01); *C10G 2300/1037* (2013.01)

(58) Field of Classification Search
CPC .... C10G 1/10; C10G 5/00; C10G 2300/1003; C10G 2300/1037; C10G 2400/20; C10G 1/002; C10G 9/00; C10B 53/07
See application file for complete search history.

(56) References Cited

U.S. PATENT DOCUMENTS

2019/0161683 A1* 5/2019 Narayanaswamy ... C10G 69/14
2019/0177626 A1 6/2019 Ramamurthy et al.
2021/0189251 A1 6/2021 Timken

FOREIGN PATENT DOCUMENTS

WO WO 2015-128033 A1 9/2015
WO WO 2016-142808 A1 9/2016
(Continued)

OTHER PUBLICATIONS

Co-Pending U.S. Appl. No. 18/567,956, filed Dec. 7, 2023; Wu et al.

(Continued)

*Primary Examiner* — Ali Z Fadhel
(74) *Attorney, Agent, or Firm* — C. Tumey Law Group PLLC

(57) ABSTRACT

Processes and facilities for providing recycled content hydrocarbon products (r-products) from separation of pyrolysis gas formed by pyrolyzing waste plastic are provided. Various separation schemes may be employed to process the recycled content pyrolysis gas (r-pygas) into one or more recycled content hydrocarbon streams, which can be used in forming a variety of recycled content products.

16 Claims, 4 Drawing Sheets

(56) References Cited

FOREIGN PATENT DOCUMENTS

| | | | | |
|---|---|---|---|---|
| WO | WO 2018-055555 | A1 | 3/2018 | |
| WO | WO 2018-127813 | A1 | 7/2018 | |
| WO | WO 2020-242916 | A1 | 12/2020 | |
| WO | WO 2021-092321 | A1 | 5/2021 | |
| WO | WO-2021087052 | A1 * | 5/2021 | ..... C10G 47/00 |

OTHER PUBLICATIONS

Notification of Transmittal of The International Search Report and The Written Opinion of The International Searching Authority, or the Declaration for International Application No. PCT/US2022/034848 date of mailing Oct. 7, 2022.

Notification of Transmittal of The International Search Report and The Written Opinion of The International Searching Authority, or the Declaration for International Application No. PCT/US2022/034864 date of mailing Oct. 26, 2022.

ASTMD86; "Standard Test Method for Distillation of Petroleum Products and Liquid Fuels at Atmospheric Pressure"; Published Feb. 2024.

ASTMD2887; "Standard Test Method for Boiling Range Distribution of Petroleum Fractions by Gas Chromatography"; Published Dec. 2023.

* cited by examiner

SEPARATION AND PROCESSING OF RECYCLED CONTENT PYROLYSIS GAS

CROSS-REFERENCE TO RELATED APPLICATION(S)

This application is a national stage filing under 35 USC § 371 of International Application Number PCT/US2022/034864, filed on, Jun. 24, 2022 which claims the benefit of the filing date to U.S. Provisional Application No. 63/202,913, filed on Jun. 30, 2021, the entire disclosures of which are incorporated by reference herein.

BACKGROUND

Waste plastic pyrolysis plays a part in a variety of chemical recycling technologies. Typically, waste plastic pyrolysis facilities focus on producing recycled content pyrolysis oil (r-pyoil) that can be readily transported to an onsite or offsite facility for further use in making recycled content products.

In addition to r-pyoil, waste plastic pyrolysis produces heavy components (e.g., waxes, tar, and char) and recycled content pyrolysis gas (r-pygas). Although r-pygas produced by the waste plastic pyrolysis typically has 100 percent recycled content, it is common practice for the r-pygas to be burned as fuel to provide heat for the pyrolysis reaction. Although burning r-pygas as fuel for pyrolysis may be economically efficient, such practice runs counter to one of the main goals of chemical recycling, which is to transform as much of the waste plastic as possible in new products. Thus, a better use for r-pygas is needed.

SUMMARY

In one aspect, the present technology concerns a chemical recycling process, the process comprising: (a) pyrolyzing waste plastic to thereby provide a recycled content pyrolysis gas (r-pygas); (b) separating the r-pygas into a first portion and a second portion; (c) introducing a first portion of the r-pygas into a cracking furnace of a cracker facility; and (d) introducing a second portion of the r-pygas into at least one location in the cracker facility downstream of the cracking furnace.

In one aspect, the present technology concerns a chemical recycling process, the process comprising: (a) pyrolyzing waste plastic to thereby provide a recycled content pyrolysis gas (r-pygas); (b) separating at least a portion of the r-pyrolysis gas in at least one separation vessel to provide an overhead vapor comprising predominantly Cn and lighter hydrocarbons and a bottoms liquid comprising predominantly C(n+1) and heavier hydrocarbons, wherein n is an integer between 1 and 5, inclusive; and (c) performing at least one of the following steps (i) and (ii)—(i) introducing at least a portion of the bottoms liquid into a furnace of a cracking facility; and (ii) introducing at least a portion of the overhead vapor into a location downstream of the furnace in the cracking facility.

In one aspect, the present technology concerns a chemical recycling process, the process comprising: (a) pyrolyzing waste plastic to thereby produce a recycled content pyrolysis gas (r-pygas); (b) separating at least a portion of the r-pygas in a first separation vessel to thereby produce a first overhead vapor and a first r-bottoms; (c) further separating at least a portion of at least one of the first overhead vapor and the first r-bottoms into a second overhead vapor and a second bottoms liquid in a second separation vessel.

In one aspect, the present technology concerns a chemical recycling process, the process comprising: chemical recycling process, the process comprising: (a) pyrolyzing waste plastic to thereby produce a recycled content pyrolysis gas (r-pygas); (b) separating at least a portion of the r-pygas into a first overhead stream and a first bottoms stream in a first separation vessel, wherein the first overhead stream comprises predominantly Cn and lighter components and wherein the first bottoms stream comprises predominantly C(n+1) and heavier components, wherein n is an integer between 1 and 5, inclusive; and (c) introducing at least a portion of the first overhead stream into a cracking furnace of a cracker facility.

DETAILED DESCRIPTION

We have discovered new methods and systems for utilizing a recycled content stream that was previously burned as fuel. More specifically, we have discovered that pyrolysis gas produced by pyrolyzing waste plastic can be separated into hydrocarbon streams of varying composition, which may also be used as or to form recycled content products.

Figure 1:
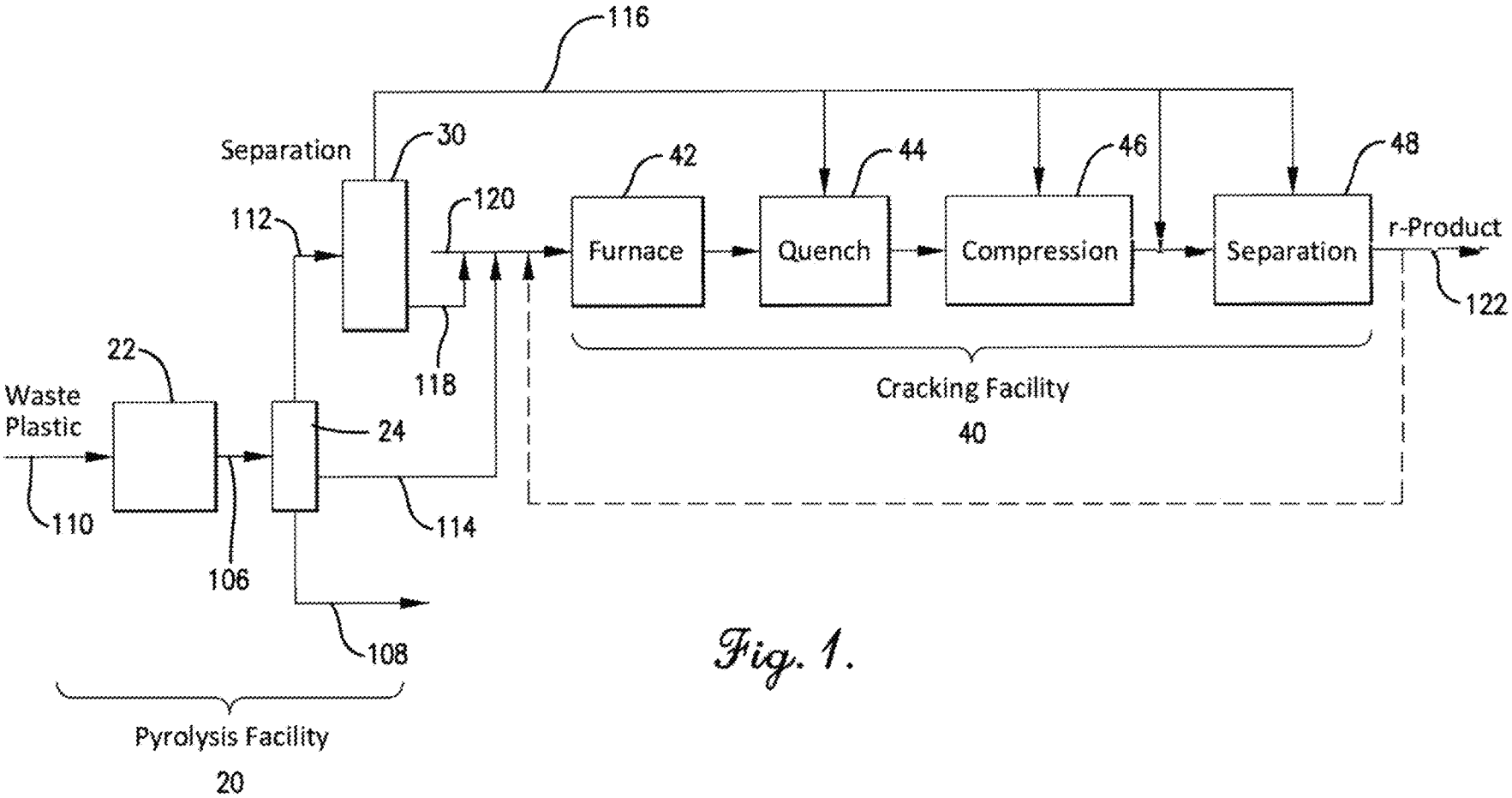
FIG. 1 is a block flow diagram illustrating the main steps of a process and facility for separating recycled content pyrolysis gas (r-pygas) into two or more portions usable in downstream processing units such as, for example, a cracking facility.

FIG. 1 illustrates one embodiment of a process and system for use in chemical recycling of waste plastic. The process shown in FIG. 1 includes a pyrolysis facility 20 and a cracking facility 40. The pyrolysis facility 20 and cracking facility 40 may be co-located or located remotely from one another. As used herein, the term "co-located" refers to the characteristic of at least two objects being situated on a common physical site, and/or within 0.5 or 1 mile of each other. As used herein, the term "located remotely" refers to a distance of greater than 1, greater than 5, greater than 10, greater than 50, greater than 100, greater than 500, greater than 1000, or greater than 10,000 miles between two facilities, sites, or reactors.

When two or more facilities are co-located, the facilities may be integrated in one or more ways. Examples of integration include, but are not limited to, heat integration, utility integration, waste-water integration, mass flow integration via conduits, office space, cafeterias, integration of plant management, IT department, maintenance department, and sharing of common equipment and parts, such as seals, gaskets, and the like.

In some embodiments, the pyrolysis facility/process 20 is a commercial scale facility/process receiving the waste plastic feedstock 110 at an average annual feed rate of at least 100, or at least 500, or at least 1,000, at least 2,000, at least 5,000, at least 10,000, at least 50,000, or at least 100,000 pounds per hour, averaged over one year. Further, the pyrolysis facility can produce the r-pyoil 114 and r-pygas 112 in combination at an average annual rate of at least 100, or at least 1,000, or at least 5,000, at least 10,000, at least 50,000, or at least 75,000 pounds per hour, averaged over one year.

Similarly, the cracking facility/process 40 can be a commercial scale facility/process receiving hydrocarbon feed 120 at an average annual feed rate of at least at least 100, or at least 500, or at least 1,000, at least 2,000, at least 5,000, at least 10,000, at least 50,000, or at least 75,000 pounds per hour, averaged over one year. Further, the cracking facility can produce at least one recycled content product stream (r-product) at an average annual rate of at least 100, or at least 1,000, or at least 5,000, at least 10,000, at least 50,000, or at least 75,000 pounds per hour, averaged over one year. When more than one r-product stream is produced, these rates can apply to the combined rate of all r-products.

As shown in FIG. 1, the process starts with a pyrolysis step where waste plastic 110 is pyrolyzed in a pyrolysis reactor 22. The pyrolysis reaction involves chemical and thermal decomposition of the sorted waste plastic introduced into the reactor. Although all pyrolysis processes may be generally characterized by a reaction environment that is substantially free of oxygen, pyrolysis processes may be further defined, for example, by the pyrolysis reaction temperature within the reactor, the residence time in the pyrolysis reactor, the reactor type, the pressure within the pyrolysis reactor, and the presence or absence of pyrolysis catalysts.

The pyrolysis reactor 22 depicted in FIG. 1 can be, for example, a film reactor, a screw extruder, a tubular reactor, a tank, a stirred tank reactor, a riser reactor, a fixed bed reactor, a fluidized bed reactor, a rotary kiln, a vacuum reactor, a microwave reactor, or an autoclave.

The pyrolysis reaction can involve heating and converting the waste plastic feedstock in an atmosphere that is substantially free of oxygen or in an atmosphere that contains less oxygen relative to ambient air. For example, the atmosphere within the pyrolysis reactor 22 may comprise not more than 5, not more than 4, not more than 3, not more than 2, not more than 1, or not more than 0.5 weight percent of oxygen.

The temperature in the pyrolysis reactor 22 can be adjusted to facilitate the production of certain end products. In some embodiments, the peak pyrolysis temperature in the pyrolysis reactor can be at least 325° C., or at least 350° C., or at least 375° C., or at least 400° C. Additionally or alternatively, the peak pyrolysis temperature in the pyrolysis reactor can be not more than 800° C., not more than 700° C., or not more than 650° C., or not more than 600° C., or not more than 550° C., or not more than 525° C., or not more than 500° C., or not more than 475° C., or not more than 450° C., or not more than 425° C., or not more than 400° C. More particularly, the peak pyrolysis temperature in the pyrolysis reactor can range from 325 to 800° C., or 350 to 600° C., or 375 to 500° C., or 390 to 450° C., or 400 to 500° C.

The residence time of the feedstock within the pyrolysis reactor 22 can be at least 1, or at least 5, or at least 10, or at least 20, or at least 30, or at least 60, or at least 180 seconds. Additionally, or alternatively, the residence time of the feedstock within the pyrolysis reactor 22 can be less than 2, or less than 1, or less than 0.5, or less than 0.25, or less than 0.1 hours. More particularly, the residence time of the feedstock within the pyrolysis reactor 22 can range from 1 second to 1 hour, or 10 seconds to 30 minutes, or 30 seconds to 10 minutes.

The pyrolysis reactor 22 can be maintained at a pressure of at least 0.1, or at least 0.2, or at least 0.3 barg and/or not more than 60, or not more than 50, or not more than 40, or not more than 30, or not more than 20, or not more than 10, or not more than 8, or not more than 5, or not more than 2, or not more than 1.5, or not more than 1.1 barg. The pressure within the pyrolysis reactor 22 can be maintained at atmospheric pressure or within the range of 0.1 to 60, or 0.2 to 10, or 0.3 to 1.5 barg.

The pyrolysis reaction in the reactor can be thermal pyrolysis, which is carried out in the absence of a catalyst, or catalytic pyrolysis, which is carried out in the presence of a catalyst. When a catalyst is used, the catalyst can be homogenous or heterogeneous and may include, for example, certain types of zeolites and other mesostructured catalysts.

As shown in FIG. 1, a pyrolysis effluent 106 is removed from the reactor 22 and can be separated in a separator 24 to produce a recycled content pyrolysis oil (r-pyoil) 114, a recycled content pyrolysis gas (r-pygas) 112, and a recycled content pyrolysis residue (r-pyrolysis residue) 108. As used herein, the term "r-pygas" refers to a composition obtained from waste plastic pyrolysis that is gaseous at 25° C. at 1 atm. As used herein, the terms "r-pyoil" refers to a composition obtained from waste plastic pyrolysis that is liquid at 25° C. and 1 atm. As used herein, the term "r-pyrolysis residue" refers to a composition obtained from waste plastic pyrolysis that is not r-pygas or r-pyoil and that comprises predominantly pyrolysis char and pyrolysis heavy waxes. As used herein, the term "pyrolysis char" refers to a carbon-containing composition obtained from pyrolysis that is solid at 200° C. and 1 atm. As used herein, the term "pyrolysis heavy waxes" refers to C20+ hydrocarbons obtained from pyrolysis that are not pyrolysis char, pyrolysis gas, or pyrolysis oil.

In one embodiment as shown in FIG. 1, at least a portion of the r-pygas 112 can be introduced into a separation vessel 30 and separated into a recycled content r-lights 116 (r-lights) and a recycled content r-heavies 118 (r-heavies). The r-lights 116 may comprise predominantly Cn and lighter components and the r-heavies 118 may comprise predominantly C(n+1) and heavier components, wherein n is an integer between 1 and 5, inclusive. As used herein, the term "predominantly" means at least 50 weight percent. As used herein, the terms "Cx" or "Cx hydrocarbon" or "Cx component" refers to a hydrocarbon compound including "x" total carbons per molecule, and encompasses all olefins, paraffins, aromatics, heterocyclic, and isomers having that number of carbon atoms. For example, each of normal, iso, and tert-butane and butene and butadiene molecules would fall under the general description "C4" or "C4 components." As used herein, the term "heavier" means having a higher boiling point and "lighter" means having a lower boiling point.

For example, the r-lights 116 (shown as the overhead stream from vessel 30) can comprise predominantly Cn (C2, C3, C4, C5) and lighter components and the r-heavies 118 (shown as the bottoms stream from separation vessel 30) can comprise predominantly C(n+1) (C3, C4, C5, C6) and heavier components. The r-lights 116 can include at least 50, at least 75, at least 90, or at least 95 percent Cn (C2, C3, C4, C5) and lighter components. The r-heavies 118 can include at least 50, at least 75, at least 90, or at least 95 percent C(n+1) (C2, C3, C4, C5, C6) and heavier components.

The r-lights 116 may include at least 50, at least 75, at least 90, or at least 95 weight percent of Cn and lighter components, while the r-heavies 118 may include at least 50, at least 75, at least 90, or at least 95 weight percent of C(n+1) and heavier components. At least 50, at least 75, at least 90, or at least 95 weight percent of the Cn and lighter components introduced into vessel 30 in the r-pygas 112 can be present in the r-lights 116, while similar amounts of C(n+1) and heavier components may be present in the r-heavies 118.

The relative amounts of the r-lights 116 and r-heavies 118 can vary. For example, the weight ratio of the r-lights 116 to r-heavies 118 can be 0.25:1 to 25:1, 0.75:1 to 15:1, or 1:1 to 10:1. Or the weight ratio can be in the range of from 0.05:1 to 40:1, 0.25:1 to 15:1, or 1.2:1 to 10:1, or from 0.15:1 to 50:1, 0.75:1 to 15:1, or 1.5:1 to 3.5:1, or 0.25:1 to 75:1, or 2:1 to 25:1, or 5:1 to 10:1. In some cases, the r-lights 116 can have a weight at least 5, at least 10, or at least 25 percent larger or smaller than the r-heavies 118, depending on the operation of the pyrolysis facility 20 and the separation vessel 30.

The specific separation performed in the separation vessel 30 depends on the composition of the r-pygas introduced into the vessel 30 and the desired end use of the resulting product streams. In some embodiments, the r-pygas includes C2 and/or C3 components each in an amount of 5 to 60, 10 to 50, or 15 to 45 weight percent, C4 components in an amount of 1 to 60, 5 to 50, or 10 to 45 weight percent, and C5 components in an amount of 1 to 25, 3 to 20, or 5 to 15 weight percent.

Vessel 30 can separate the r-pygas so that at least 50, at least 75, at least 90, or at least 95 percent of the total amount of Cn (C1, C2, C3, C4, C5) and lighter components introduced in the r-pygas 112 are present in the r-lights 116 and/or so that at least 50, at least 75, at least 90, or at least 95 percent of the total amount of C(n+1) (C2, C3, C4, C5, C6) and heavier components introduced into the r-pygas are present in the r-heavies 118.

In some embodiments, vessel 30 can be a distillation column such as a demethanizer, deethanizer, a depropanizer, a debutanizer, or a depentanizer. The overhead stream from the vessel 30 can have a composition typical of a demethanizer (deethanizer, depropanizer, debutanizer, or depentanizer) overhead stream, and the bottom stream from the vessel 30 can have a composition typical of a demethanizer (deethanizer, depropanizer, debutanizer, or depentanizer) bottom stream.

Vessel 30 can be any suitable type of vapor-liquid separation vessel and, in some embodiments, can include mass transfer internals such as trays, packing, and combinations thereof. Although shown in FIG. 1 as including a single vessel, it should be understood that vessel 30 can include two or more vessels configured to achieve the desired separation. Some embodiments with more than one vessel are discussed in detail with respect to FIGS. 3*a* and 3*b*.

In some embodiments, the r-lights 116, the r-heavies 118, or both the r-lights 116 and r-heavies 118 can be introduced into a cracking facility 40. In one embodiment shown in FIG. 1, the r-heavies 118 can be introduced at the inlet (upstream) of the cracking furnace 42, while the r-lights 116 can be introduced into at least one location downstream of the cracking furnace 42.

For example, as shown in FIG. 1, the r-lights 116 can be introduced into one or more of the following locations downstream of the cracking furnace 42: (i) the quench zone 44, which cools and partially condenses the furnace effluent; (ii) the compression zone 46, which compresses the vapor portion of the furnace effluent in two or more compression stages; and (iii) the separation zone 48, which separates the compressed stream into two or more recycled content products (r-products). In some cases, the r-lights 116 may be introduced into only one of these locations, while, in other cases, the r-lights 116 may be divided into additional fractions and each fraction introduced into a different location. In such cases, the fractions of the r-lights 116 may be introduced into at least two, three, or all of the locations shown in FIG. 1.

When introduced into the quench zone 44, the r-lights 116 can be introduced into a separation or quench vessel, or into the inlet or effluent of the quench zone 44. In some cases, this may include heating and/or compressing the r-lights 116 so that it has a temperature within about 150, about 125, or about 100° C. and/or a pressure within about 75, about 50, or about 25 psi of the stream or vessel into which the r-lights 116 is being introduced.

When introduced into the compression section 46, the r-lights 116 may be introduced upstream of the first compression stage, downstream of the last compression stage, or upstream of one or more intermediate compression stages.

When introduced into the separation zone 48, the r-lights 116 may be introduced into the inlet of one or more of the separation columns, or may be combined with a stream, such as an overhead or bottoms stream, withdrawn from one or more of the separation columns.

As shown in FIG. 1, a portion or all of the r-heavies 118 from the separation vessel 30 can be introduced into the inlet of the cracker furnace. When introduced into the cracker furnace 42, the r-heavies 118 can comprise predominantly C3 (C4, C5, C6) components. The r-heavies 118 may be combined with a hydrocarbon containing cracker feed 120 or the r-heavies 118 and hydrocarbon containing cracker feed 120 can be introduced separately (not shown).

In some embodiments, the hydrocarbon containing cracker feed 120 can comprise predominantly C3 to C22 components (C5 to C22, C4 to C20, C5 to C18), while in other embodiments, it can comprise predominantly C2 or C2 to C4 components. The hydrocarbon containing cracker feed 120 can include recycled content (r-HC stream), such as from a stream of r-pyoil 118 as shown in FIG. 1, or from one or more other types of chemical recycling facilities. In some cases, hydrocarbon containing cracker feed may also include some non-recycled content or it may not include any recycled content.

As shown in FIG. 1, the combined stream may be introduced into the cracking furnace 42, wherein it can be thermally cracked to form a lighter hydrocarbon effluent. The effluent stream can then be cooled in the quench zone 44 and compressed in the compression zone 46. The compressed stream from the compression zone 46 can be further separated in the separation zone 48 to produce at least one recycled content product (r-product) 122. Examples of recycled content products include, but are not limited to, recycled content ethane (r-ethane), recycled content ethylene (r-ethylene), recycled content propane (r-propane), recycled content propylene (r-propylene), recycled content butane (r-butane), recycled content butenes (r-butenes), recycled content butadiene (r-butadiene), and recycled content pentanes and heavier (r-C5+). In some embodiments, at least a portion of the recycled content stream (e.g., r-ethane or r-propane) may be returned to the inlet of the cracking furnace as a reaction recycle stream, shown as the dashed line in FIG. 1.

Figure 2:
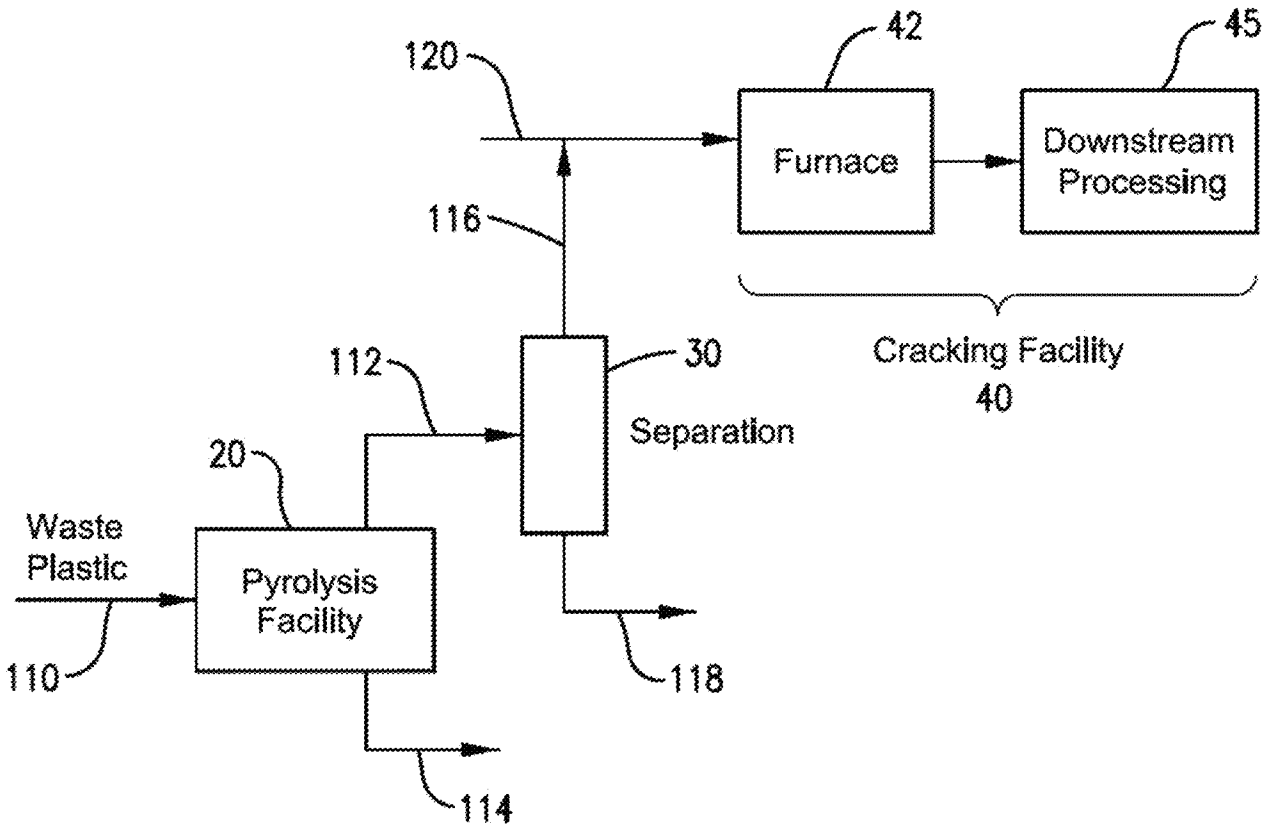
FIG. 2 is a block flow diagram illustrating the main steps of a process and facility for separating r-pygas into two or more portions, particularly illustrating one embodiment wherein the lighter fraction is introduced into the inlet of a cracking furnace.

Turning now to FIG. 2, another embodiment of a chemical recycling facility is shown. Similarly to the embodiment shown in FIG. 1, r-pygas 112 formed by pyrolysis of waste plastic 110 in a pyrolysis facility 20 is separated into r-lights 116 and r-heavies 118 in a separation vessel 30. However, as shown in FIG. 2, the r-lights 116 may be introduced into the inlet (upstream) of the cracking furnace 42, separately or in combination with a hydrocarbon containing cracker feed 120. All or a portion of the r-lights 116 from the r-pygas 112 passing through the cracking furnace 42 can be thermally cracked and the resulting effluent sent to the downstream processing zones 45 as discussed with respect to FIG. 1.

Figure 3D:
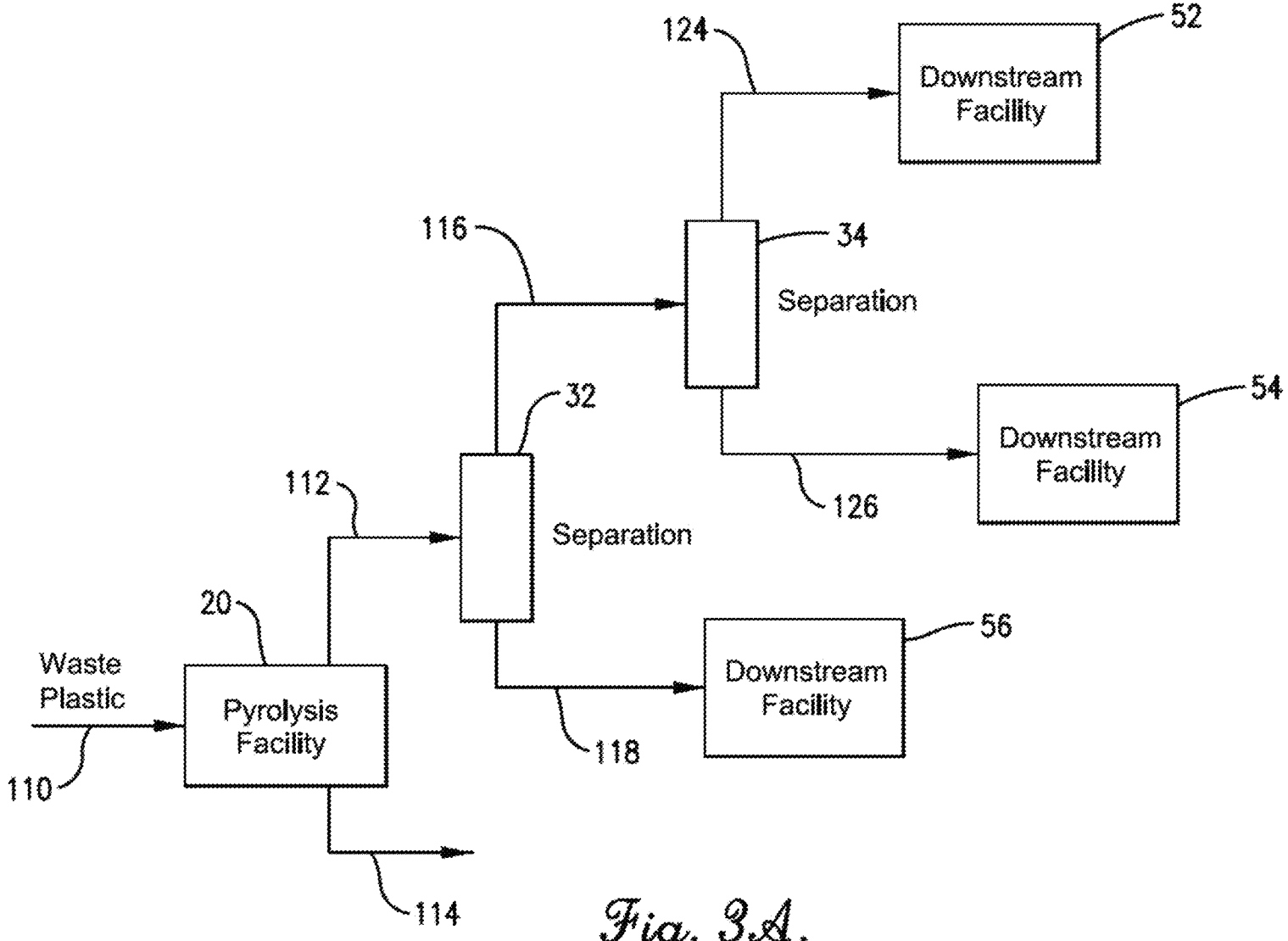
FIG. 3*a* is a block flow diagram illustrating the main steps of a process and facility for separating r-pygas into two or more portions, particularly illustrating one embodiment wherein the lighter fraction is further separated and the resulting streams are sent for further processing.
FIG. 3*b* is a block flow diagram illustrating the main steps of a process and facility for separating r-pygas into two or more portions, particularly illustrating one embodiment wherein the heavier fraction is further separated, and the resulting streams are sent for further processing.
Figure 3B:
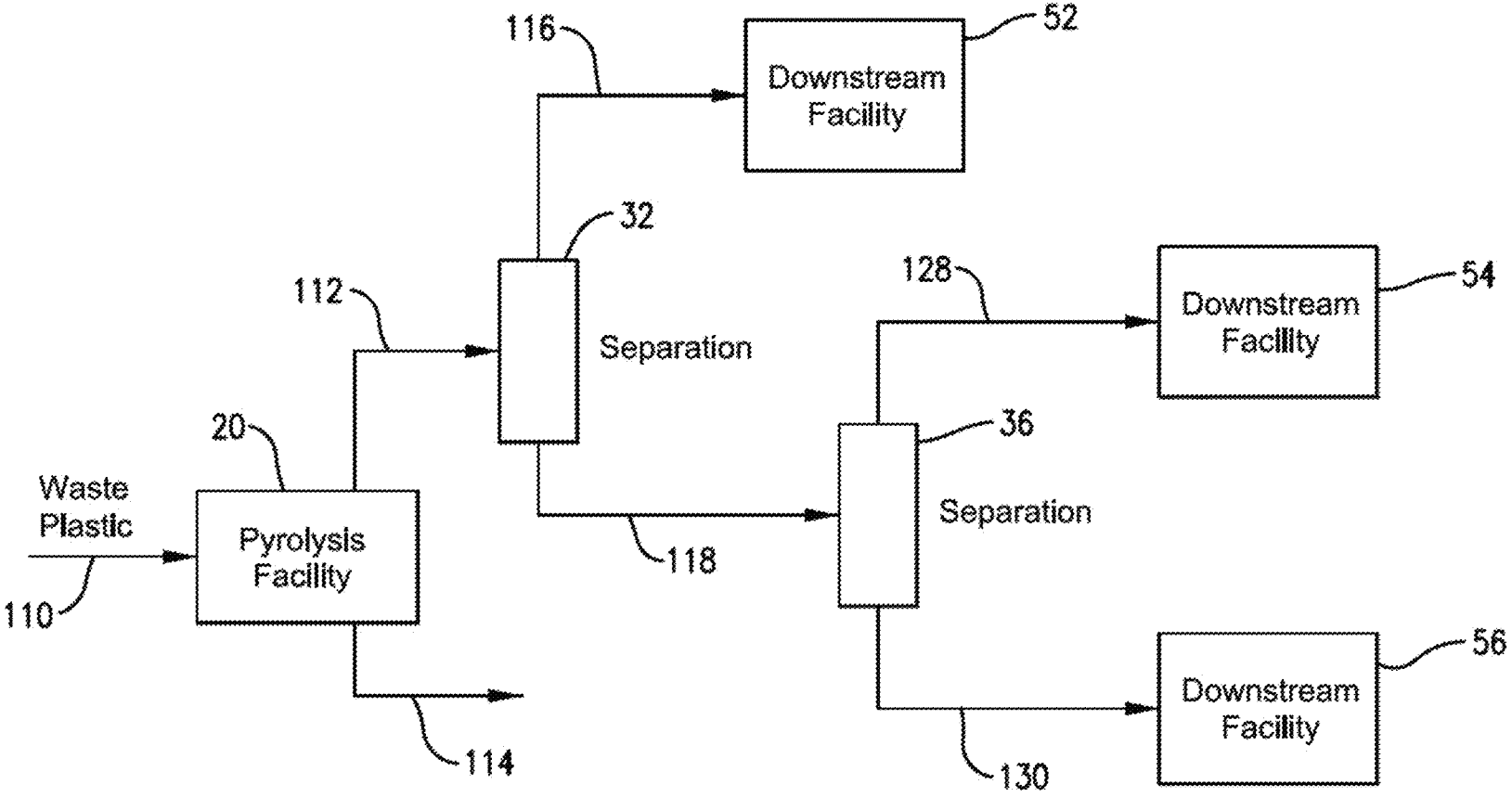

Turning now to FIGS. 3*a* and 3*b*, embodiments of chemical processing facilities are shown where at least a portion of the r-pygas 112 formed by pyrolysis of waste plastic 110 is separated using multiple separation vessels 32, 34. In the embodiment shown in FIG. 3*a*, the r-pygas 112 is separated in a first separation vessel 32 into r-lights 116 and r-heavies 118, and the r-lights 116 is further separated in a second separation vessel 34 to form a second recycled content overhead stream (second r-overhead) 124 and a second recycled content bottoms stream (second r-bottoms) 126. At least one, two, or all of the r-heavies 118 from the first separation vessel 32, the second r-overhead 124, and the second r-bottoms 126 can be sent to a downstream facility for further processing, transport, and/or storage, as shown by boxes 52, 54, and 56 in FIG. 3*a*.

The configuration shown in FIG. 3*a* may be useful when the r-lights 116 of comprises predominantly C2 (C3, C4, C5) and lighter components. For example, when the r-lights 116 from the first separation vessel 32 includes predominantly (or at least 75, at least 90, or at least 95 percent) C2 and lighter components, the second r-overhead from the second vessel 34 may comprise a predominantly C1 and lighter stream 124 and the second r-bottoms from the second vessel 34 may comprise a predominantly C2 stream. In such cases, the second r-overhead 124 can include at least 50, at least 75, at least 90, or at least 95 percent C1 and lighter hydrocarbon components, and the second r-bottoms 126 can include at least 50, at least 75, at least 90, or at least 95 percent C2 hydrocarbon components. In this case, the first vessel 32 may be a deethanizer and the second vessel may be a demethanizer.

In these embodiments, the second r-overhead 124 can include at least 50, at least 75, at least 90, or at least 95 percent of the total weight of C1 and lighter components introduced into the second separation vessel 34. It may also include less than 25, less than 10, or less than 5 percent of C2 and heavier components. As shown in FIG. 3*a*, the second r-overhead 124 can be introduced into a downstream facility 52, which may include one or more of a storage vessel, a reaction vessel, a transportation vessel or vehicle, a separation vessel, or combinations thereof.

In some embodiments, the second r-bottoms 126 from the second vessel 34 can comprise C2 components in an amount of at least 50, at least 75, at least 90, or at least 95 weight percent. In some embodiments, all or a portion of the C2 hydrocarbon components may be further separated to form one or more recycled content products, such as for example, recycled content ethane (r-ethane).

When the r-lights 116 from the first separation vessel 32 includes predominantly (or at least 75, at least 90, or at least 95 percent) C3 and lighter components, the second r-overhead from the second vessel 34 may comprise a predominantly C2 and lighter stream 124 and the second r-bottoms from the second vessel 34 may comprise a predominantly C3 stream. In such cases, the second r-overhead 124 can include at least 50, at least 75, at least 90, or at least 95 percent C2 and lighter hydrocarbon components, and the second r-bottoms 126 can include at least 50, at least 75, at least 90, or at least 95 percent C3 hydrocarbon components. In this case, the first vessel 32 may be a depropanizer and the second vessel may be a deethanizer.

In these embodiments, the second r-overhead 124 can include at least 50, at least 75, at least 90, or at least 95 percent of the total weight of C2 and lighter components introduced into the second separation vessel 34. It may also include less than 25, less than 10, or less than 5 percent of C3 and heavier components. As shown in FIG. 3*a*, the second r-overhead 124 can be introduced into a downstream facility 52, which may include one or more of a storage vessel, a reaction vessel, a transportation vessel or vehicle, a separation vessel, or combinations thereof.

In some embodiments, the second r-bottoms 126 from the second vessel 34 can comprise C3 components in an amount of at least 50, at least 75, at least 90, or at least 95 weight percent. In some embodiments, all or a portion of the C3 hydrocarbon components may be further separated to form one or more recycled content products, such as for example, recycled content ethane (r-propane).

When the r-lights 116 from the first separation vessel 32 includes predominantly (or at least 75, at least 90, or at least 95 percent) C4 and lighter components, the second r-overhead from the second vessel 34 may comprise a predominantly C3 and lighter stream 124 and the second r-bottoms from the second vessel 34 may comprise a predominantly C4 stream. In such cases, the second r-overhead 124 can include at least 50, at least 75, at least 90, or at least 95 percent C3 and lighter hydrocarbon components, and the second r-bottoms 126 can include at least 50, at least 75, at least 90, or at least 95 percent C4 hydrocarbon components. In this case, the first vessel 32 may be a debutanizer and the second vessel may be a depropanizer.

In these embodiments, the second r-overhead 124 can include at least 50, at least 75, at least 90, or at least 95 percent of the total weight of C3 and lighter components introduced into the second separation vessel 34. It may also include less than 25, less than 10, or less than 5 percent of C4 and heavier components. As shown in FIG. 3*a*, the second r-overhead 124 can be introduced into a downstream facility 52, which may include one or more of a storage vessel, a reaction vessel, a transportation vessel or vehicle, a separation vessel, or combinations thereof.

In some embodiments, the second r-bottoms 126 from the second vessel 34 can comprise C4 components in an amount of at least 50, at least 75, at least 90, or at least 95 weight percent. In some embodiments, all or a portion of the C4 hydrocarbon components may be further separated to form one or more recycled content products, such as for example, recycled content butane (r-butane).

In some embodiments, the second r-bottoms 126 from the second vessel 34 can comprise C4 olefins in an amount of at least 10, at least 15, at least 20, at least 25, at least 30, at least 35, at least 40, or at least 50 weight percent. The C4 olefins may include single olefins (such as isobutane and 1-butene), diolefins (such as butadiene), or combinations thereof. In some embodiments, all or a portion of the C4 olefins may be separated from the second r-bottoms stream 126 and may be routed to a downstream processing facility 54 that includes a polymerization or alkylation facility. Alternatively, or in addition, the downstream facility 54 can include a storage vessel, a transportation vessel or vehicle, a separation facility or combinations thereof.

In one embodiment, the second r-bottoms including C4 olefins can be introduced into another separation vessel (or vessels) and further separated to remove at least 10, at least 20, at least 25, at least 30, at least 35, at least 40, at least 45, at least 50, at least 75, or at least 90 percent of the C4 olefins from the C4 stream. At least a portion of the C4 olefins can then be introduced into a downstream facility 54, wherein it can be further processed to provide a recycled content product (r-product). For example, the downstream facility 54 can be an alkylation facility and the r-product can be recycled content gasoline (r-gasoline) or recycled content jet fuel (r-jet fuel). In another embodiment, the downstream facility 54 can be a reaction zone including a polymerization zone, a hydrogenation zone, or an isomerization zone.

When the r-lights 116 from the first separation vessel 32 includes predominantly (or at least 75, at least 90, or at least 95 percent) C5 and lighter components, the second r-overhead from the second vessel 34 may comprise a predominantly C4 and lighter stream 124 and the second r-bottoms from the second vessel 34 may comprise a predominantly C5 stream. In such cases, the second r-overhead 124 can include at least 50, at least 75, at least 90, or at least 95 percent C4 and lighter hydrocarbon components, and the second r-bottoms 126 can include at least 50, at least 75, at least 90, or at least 95 percent C5 hydrocarbon components. In this case, the first vessel 32 may be a depentanizer and the second vessel may be a debutanizer.

In these embodiments, the second r-overhead 124 can include at least 50, at least 75, at least 90, or at least 95 percent of the total weight of C4 and lighter components introduced into the second separation vessel 34. It may also include less than 25, less than 10, or less than 5 percent of C5 and heavier components. As shown in FIG. 3*a*, the second r-overhead 124 can be introduced into a downstream facility 52, which may include one or more of a storage vessel, a reaction vessel, a transportation vessel or vehicle, a separation vessel, or combinations thereof.

In some embodiments, the second r-bottoms 126 from the second vessel 34 can comprise C5 components in an amount of at least 50, at least 75, at least 90, or at least 95 weight percent. In some embodiments, all or a portion of the C5 hydrocarbon components may be further separated to form one or more recycled content products, such as for example, recycled content C5 and heavier components (r-C5+).

In some embodiments, the second r-bottoms 126 can comprise C5 and heavier components in an amount of at least 50, at least 75, at least 90, or at least 95 weight percent. In some embodiments, all or a portion of the C5 and heavier components may be routed to a downstream processing facility 54 that includes a polymerization facility. Alternatively, or in addition, the downstream facility 54 can include a storage vessel, a transportation vessel or vehicle, a separation facility or combinations thereof. In one embodiment, the C5 stream can be introduced into a polymerization zone, wherein at least a portion can be reacted to form a recycled content C5 hydrocarbon resin (r-C5).

Turning now to FIG. 3*b*, the r-pygas 112 is separated in a first separation vessel 32 into a r-lights 116 and a r-heavies 118, and the r-heavies 118 is further separated in a second separation vessel 34 to form a second recycled content light stream (second r-lights) 128 and a second recycled content heavies stream (second r-heavies) 130. At least one, two, or all of the r-heavies 118 from the first separation vessel 32, the second r-lights 128, and second r-heavies 130 from the second separation vessel 34 can be sent to a downstream facility for further processing, transport, and/or storage, as shown by boxes 52, 54, and 56 in FIG. 3*b*.

The configuration shown in FIG. 3*b* may be useful when the r-heavies 118 of the r-pygas comprises predominantly C2 (C3, C4, C5) and heavier components. For example, when the r-heavies 118 of the r-pygas from the first separation vessel includes predominantly (or at least 75, at least 90, or at least 95 percent) C2 and heavier components, the second r-lights 128 can comprise a predominantly C2 stream and the second r-heavies 130 can comprise a predominantly C3 and heavier stream. In such cases, the second r-lights 128 can include at least 50, at least 75, at least 90, or at least 95 percent C2 hydrocarbon components, and the second r-heavies 130 can include at least 50, at least 75, at least 90, or at least 95 percent C3 and heavier hydrocarbon components. In this case, the first vessel 32 may be a demethanizer and the second vessel 34 may be a deethanizer.

In these embodiments, the second r-overhead 128 can include at least 50, at least 75, at least 90, or at least 95 percent of the total weight of C2 and lighter components introduced into the second separation vessel 34. It may also include less than 25, less than 10, or less than 5 percent of C3 and heavier components. In some embodiments, all or a portion of the C2 hydrocarbon components in the second r-overhead 128 may be transported or sold as an r-ethane product and/or it may be routed to a downstream facility 54 that includes a storage vessel, a transportation vessel, and/or a separation facility.

In some embodiments, the second r-bottoms 130 from the second separation vessel 34 can comprise C3 and heavier components in an amount of at least 50, at least 75, at least 90, or at least 95 weight percent. As shown in FIG. 3*b*, the second r-bottoms can be introduced into a downstream facility 56. The downstream facility 56 can include one or more of a storage vessel, a reaction vessel, a transportation vessel or vehicle, a separation vessel, or combinations thereof.

When the r-heavies 118 of the r-pygas from the first separation vessel includes predominantly (or at least 75, at least 90, or at least 95 percent) C3 and heavier components, the second r-lights 128 can comprise a predominantly C3 stream and the second r-heavies 130 can comprise a predominantly C4 and heavier stream. In such cases, the second r-lights 128 can include at least 50, at least 75, at least 90, or at least 95 percent C3 hydrocarbon components, and the second r-heavies 130 can include at least 50, at least 75, at least 90, or at least 95 percent C4 and heavier hydrocarbon components. In this case, the first vessel 32 may be a deethanizer and the second vessel 34 may be a depropanizer.

In these embodiments, the second r-overhead 128 can include at least 50, at least 75, at least 90, or at least 95 percent of the total weight of C3 and lighter components introduced into the second separation vessel 34. It may also include less than 25, less than 10, or less than 5 percent of C4 and heavier components. In some embodiments, all or a portion of the C3 hydrocarbon components in the second r-overhead 128 may be transported or sold as an r-propane product and/or it may be routed to a downstream facility 54 that includes a storage vessel, a transportation vessel, and/or a separation facility. Alternatively, or in addition, the lighter stream 128 may include C3 olefins, which may be separated from the C3 stream via another separation vessel (not shown) and passed to a polymerization unit, directly or via one or more storage or transport vessels.

In some embodiments, the second r-bottoms 130 from the second separation vessel 34 can comprise C4 and heavier components in an amount of at least 50, at least 75, at least 90, or at least 95 weight percent. As shown in FIG. 3*b*, the second r-bottoms 130 can be introduced into a downstream facility 56. The downstream facility 56 can include one or more of a storage vessel, a reaction vessel, a transportation vessel or vehicle, a separation vessel, or combinations thereof.

When the r-heavies 118 of the r-pygas from the first separation vessel includes predominantly (or at least 75, at least 90, or at least 95 percent) C4 and heavier components, the second r-lights 128 can comprise a predominantly C4 stream and the second r-heavies 130 can comprise a predominantly C5 and heavier stream. In such cases, the second r-lights 128 can include at least 50, at least 75, at least 90, or at least 95 percent C4 hydrocarbon components, and the second r-heavies 130 can include at least 50, at least 75, at least 90, or at least 95 percent C5 and heavier hydrocarbon components. In this case, the first vessel 32 may be a depropanizer and the second vessel 34 may be a debutanizer.

In these embodiments, the second r-overhead 128 can include at least 50, at least 75, at least 90, or at least 95 percent of the total weight of C4 and lighter components introduced into the second separation vessel 34. It may also include less than 25, less than 10, or less than 5 percent of C5 and heavier components. In some embodiments, all or a portion of the C4 hydrocarbon components in the second r-overhead 128 may be transported or sold as an r-butane product and/or it may be routed to a downstream facility 54 that includes a storage vessel, a transportation vessel, and/or a separation facility.

In some embodiments, the second r-overhead 128 from the second vessel 34 can comprise C4 olefins in an amount of at least 10, at least 15, at least 20, at least 25, at least 30, at least 35, at least 40, or at least 50 weight percent. The C4 olefins may include single olefins (such as isobutane and 1-butene), diolefins (such as butadiene), or combinations thereof. In some embodiments, all or a portion of the C4 olefins may be separated from the second r-overhead 128 and may be routed to a downstream processing facility 54 that includes a polymerization or alkylation facility. Alternatively, or in addition, the downstream facility 54 can include a storage vessel, a transportation vessel or vehicle, a separation facility or combinations thereof.

In one embodiment, the second r-overhead 128 including C4 olefins can be introduced into another separation vessel (or vessels) and further separated to remove at least 10, at least 20, at least 25, at least 30, at least 35, at least 40, at least 45, at least 50, at least 75, or at least 90 percent of the C4 olefins from the C4 stream. At least a portion of the C4 olefins can then be introduced into a downstream facility 54, wherein it can be further processed to provide a recycled content product (r-product). For example, the downstream facility 54 can be an alkylation facility and the r-product can be recycled content gasoline (r-gasoline) or recycled content jet fuel (r-jet fuel). In another embodiment, the downstream facility 54 can be a reaction zone including a polymerization zone, a hydrogenation zone, or an isomerization zone.

In some embodiments, the second r-bottoms 130 from the second separation vessel 34 can comprise C5 and heavier components in an amount of at least 50, at least 75, at least 90, or at least 95 weight percent. As shown in FIG. 3*b*, the second r-bottoms 130 can be introduced into a downstream facility 56. The downstream facility 56 can include one or more of a storage vessel, a reaction vessel, a transportation vessel or vehicle, a separation vessel, or combinations thereof.

When the r-heavies 118 of the r-pygas from the first separation vessel includes predominantly (or at least 75, at least 90, or at least 95 percent) C5 and heavier components, the second r-lights 128 can comprise a predominantly C5 stream and the second r-heavies 130 can comprise a predominantly C6 and heavier stream. In such cases, the second r-lights 128 can include at least 50, at least 75, at least 90, or at least 95 percent C5 hydrocarbon components, and the second r-heavies 130 can include at least 50, at least 75, at least 90, or at least 95 percent C6 and heavier hydrocarbon components. In this case, the first vessel 32 may be a debutanizer and the second vessel 34 may be a depentanizer.

In these embodiments, the second r-overhead 128 can include at least 50, at least 75, at least 90, or at least 95 percent of the total weight of C5 and lighter components introduced into the second separation vessel 34. It may also include less than 25, less than 10, or less than 5 percent of C6 and heavier components. In some embodiments, all or a portion of the C5 hydrocarbon components in the second r-overhead 128 may be transported or sold as an r-C5 product and/or it may be routed to a downstream facility 54 that includes a storage vessel, a transportation vessel, and/or a separation facility. In some embodiments, at least a portion of the r-C5 stream can be introduced into a polymerization facility to produce a recycled content C5 resin product (r-C5 resin).

In some embodiments, the second r-bottoms 130 from the second separation vessel 34 can comprise C6 and heavier components in an amount of at least 50, at least 75, at least 90, or at least 95 weight percent. As shown in FIG. 3*b*, the second r-bottoms 130 can be introduced into a downstream facility 56. The downstream facility 56 can include one or more of a storage vessel, a reaction vessel, a transportation vessel or vehicle, a separation vessel, or combinations thereof.

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the phrase "at least a portion" includes at least a portion and up to and including the entire amount or time period.

As used herein, the term "chemical recycling" refers to a waste plastic recycling process that includes a step of chemically converting waste plastic polymers into lower molecular weight polymers, oligomers, monomers, and/or non-polymeric molecules (e.g., hydrogen, carbon monoxide, methane, ethane, propane, ethylene, and propylene) that are useful by themselves and/or are useful as feedstocks to another chemical production process(es).

As used herein, the term "co-located" refers to the characteristic of at least two objects being situated on a common physical site, and/or within one mile of each other.

As used herein, the term "commercial scale facility" refers to a facility having an average annual feed rate of at least 500 pounds per hour, averaged over one year.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the term "cracking" refers to breaking down complex organic molecules into simpler molecules by the breaking of carbon-carbon bonds.

As used herein, the terms "including," "include," and "included" have the same open-ended meaning as "comprising," "comprises," and "comprise" provided above.

As used herein, the term "located remotely" refers to a distance of greater than 1, 5, 10, 50, 100, 500, 1000, or 10,000 miles between two facilities, sites, or reactors. As used herein, the term "predominantly" means more than 50 percent by weight. For example, a predominantly propane stream, composition, feedstock, or product is a stream, composition, feedstock, or product that contains more than 50 weight percent propane.

As used herein, the term "pyrolysis" refers to thermal decomposition of one or more organic materials at elevated temperatures in an inert (i.e., substantially oxygen free) atmosphere.

As used herein, the terms "pyrolysis gas" and "pygas" refer to a composition obtained from pyrolysis that is gaseous at 25° C.

As used herein, the terms "pyrolysis oil" or "pyoil" refers to a composition obtained from pyrolysis that is liquid at 25° C. and 1 atm.

As used herein, the term "pyrolysis residue" refers to a composition obtained from pyrolysis that is not pyrolysis gas or pyrolysis oil and that comprises predominantly pyrolysis char and pyrolysis heavy waxes.

As used herein, the term "recycled content" refers to being or comprising a composition that is directly and/or indirectly derived from recycled material.

As used herein, the term "waste material" refers to used, scrap, and/or discarded material.

As used herein, the terms "waste plastic" and "plastic waste" refer to used, scrap, and/or discarded plastic materials.

Additional Claim Supporting Description—First Embodiment

In a first embodiment of the present technology there is provided a chemical recycling process, the process comprising: (a) pyrolyzing waste plastic to thereby provide a recycled content pyrolysis gas (r-pygas); (b) separating the r-pygas into a first portion and a second portion; (c) introducing a first portion of the r-pygas into a cracking furnace of a cracker facility; and (d) introducing a second portion of the r-pygas into at least one location in the cracker facility downstream of the cracking furnace.

The first embodiment described in the preceding paragraph can also include one or more of the additional aspects/features listed in the following bullet pointed paragraphs. Each of the below additional features of the first embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

- wherein the first portion is a predominantly C2 (C3, C4, C5, C6) and heavier hydrocarbon stream.
- wherein the first portion comprises at least 75, 90, 95 weight percent of C2 (C3, C4, C5, C6) hydrocarbon components.
- wherein the first portion comprises less than 25, 10, 5, 1 weight percent of C2 (C3, C4, C5, C6) and heavier hydrocarbon components.
- wherein at least 50, 75, 90 weight percent of the C2 (C3, C4, C5, C6) and heavier hydrocarbon components in the r-pygas are present in the first portion.
- wherein the second portion is a predominantly C1 (C2, C3, C4, C5) and lighter hydrocarbon stream.
- wherein the second portion comprises at least 75, 90, 95 weight percent of C1 (C2, C3, C4, C5) and lighter components.
- wherein the second portion comprises less than 25, 10, 5, 1 weight percent of C2 (C3, C4, C5, C6) and heavier components.
- wherein at least 50, 75, 90 weight percent of the C1 (C2, C3, C4, C5) and lighter components present in the r-pygas are present in the second portion.
- wherein said pyrolyzing includes forming a pyrolysis effluent vapor and further comprising separating at least a portion of the pyrolysis vapor to form the r-pygas and a recycled content pyrolysis oil (r-pyoil).
  - further comprising, introducing at least a portion of the r-pyoil into the cracker furnace.
- wherein the ratio of the mass flow rate of the second portion to the mass flow rate of the first portion is at least 0.25:1 to 25:1, 0.75:1 to 15:1, or 1:1 to 10:1.
- further comprising introducing the second portion into a quench zone of the cracker facility.
- further comprising introducing the second portion into a compression zone of the cracker facility.
- wherein the r-pygas comprises C2 hydrocarbon components in an amount of 5 to 60, 10 to 50, or 15 to 45 weight percent.
- wherein the r-pygas comprises C3 hydrocarbon components in an amount of 5 to 60, 10 to 50, or 15 to 45 weight percent.
- wherein the r-pygas comprises C4 hydrocarbon components in an amount of 1 to 60, 5 to 50, or 10 to 45 weight percent.
- wherein the r-pygas comprises C5 hydrocarbon components in an amount of 1 to 25, 3 to 20, or 5 to 15 percent.
- further comprising cracking at least a portion of the first portion in the cracking furnace to provide a recycled content furnace effluent, and combining the second portion of the r-pygas with at least a portion of the recycled content furnace effluent (r-effluent).
- wherein the second portion comprises at least 10, 15, 20, 25, 30, 35, or 40 weight percent of C4 olefins and further comprising separating out at least 50, 75, or 90 percent of the C4 olefins in the separation zone to provide a predominantly C4 olefin stream.
  - further comprising reacting at least a portion of the C4 olefin stream in at least one downstream reaction to provide a recycled content product.
    - wherein the reaction includes alkylation and the product includes C6 to C16 gasoline.
    - wherein the C4 olefins comprise C4 diolefins and the reaction includes polymerization, hydrogenation, and/or isomerization of at least a portion of the C4 diolefins.

wherein the second portion comprises at least 10, 15, 20, 25, 30, 35, or 40 weight percent of C5 hydrocarbon components and further comprising separating out at least 50, 75, 90 percent of the C5 hydrocarbon components to provide a predominantly C5 stream.

further comprising reacting at least a portion of the C5 stream in at least one downstream reaction to provide a recycled content product.

wherein the C5 hydrocarbon components include C5 olefins, and wherein the reaction includes polymerization and the product includes a hydrocarbon resin.

wherein the second portion includes predominantly C2 (C3, C4, C5) hydrocarbon components and further comprising separating out at least 50, 75, 90 percent of the C2 (C3, C4, C5) hydrocarbon components in the second portion to provide a stream enriched in C2 (C3, C4, C5).

further comprising combining the first portion with a hydrocarbon feed stream introduced into the cracker and cracking the combined stream to produce a furnace effluent.

wherein the hydrocarbon feed stream includes non-recycled content.

wherein the hydrocarbon feed stream includes predominantly C3 to C5 hydrocarbons.

wherein the hydrocarbon feed stream includes predominantly C5 to C22 hydrocarbons.

further comprising, providing at least one recycled content product stream from a separation zone of the cracker facility, wherein the product stream comprises recycled content C2 (C3, C4, or C5+) hydrocarbons.

wherein the recycled content C2 comprises predominantly recycled content ethylene (r-ethylene).

wherein the recycled content C3 comprises predominantly recycled content propylene (r-propylene).

wherein the recycled content C4 comprises predominantly recycled content butylene (r-butylene).

wherein the recycled content C5 comprises predominantly recycled content pentene (r-pentene).

further comprising, removing a stream comprising recycled content C2 (C3, C4) from the separation zone and returning at least a portion of the recycled content C2 (C3, C4) to the inlet of the cracking furnace.

wherein the pyrolysis facility and the cracker facility are co-located.

wherein the pyrolysis facility and the cracker facility are both commercial scale.

Additional Claim Supporting Description—Second Embodiment

In a second embodiment of the present technology there is provided a chemical recycling process, the process comprising: (a) pyrolyzing waste plastic to thereby provide a recycled content pyrolysis gas (r-pygas); (b) separating at least a portion of the r-pyrolysis gas in at least one separation vessel to provide an overhead gas comprising predominantly Cn and lighter hydrocarbons and a bottoms liquid comprising predominantly C(n+1) and heavier hydrocarbons, wherein n is an integer between 1 and 5, inclusive; and (c) performing at least one of the following steps (i) and (ii)—(i) introducing at least a portion of the bottoms liquid into a furnace of a cracking facility; and (ii) introducing at least a portion of the overhead gas into a location downstream of the furnace in the cracking facility.

The second embodiment described in the preceding paragraph can also include one or more of the additional aspects/features listed in the following bullet pointed paragraphs. Each of the below additional features of the second embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

wherein said pyrolyzing includes forming a recycled content pyrolysis effluent vapor (r-pyrolysis vapor) and separating the r-pyrolysis vapor to form the r-pygas and a recycled content pyrolysis oil (r-pyoil).

further comprising introducing at least a portion of the r-pyoil into the inlet of the furnace of the cracking facility.

wherein the bottoms liquid stream includes at least 50, 75, 90, 95 weight percent of C(n+1) and heavier hydrocarbons.

wherein the overhead gas stream includes at least 70, 75, 90, 95 weight percent of Cn and lighter hydrocarbons.

wherein the bottoms liquid stream includes at least 50, 75, 90, 95 weight percent of the total amount of C(n+1) and heavier hydrocarbon introduced into the separation vessel.

wherein the overhead gas stream includes at least 50, 75, 90, 95 weight percent of the total amount of Cn and lighter hydrocarbon components introduced into the separation vessel.

wherein the separation vessel comprises a deethanizer (depropanizer, debutanizer, depentanizer).

wherein the overhead gas stream is a deethanizer (depropanizer, debutanizer, depentanizer) overhead gas stream.

wherein the bottoms liquid stream is a deethanizer (depropanizer, debutanizer, depentanizer) bottoms liquid stream.

wherein step (c) includes performing (i).

wherein the overhead gas is introduced at a location within the compressor zone.

wherein the overhead gas is introduced at a location within the quench zone.

wherein n is 1 and the overhead gas comprises predominantly C1 and lighter and the bottoms liquid comprises predominantly C2 and heavier.

wherein step (c) includes performing (i).

wherein step (c) includes performing (ii).

wherein step (c) includes performing both (i) and (ii).

wherein n is 2 and the overhead gas comprises predominantly C2 and lighter and the bottoms liquid comprises predominantly C3 and heavier.

wherein step (c) includes performing (i).

wherein step (c) includes performing (ii).

wherein step (c) includes performing both (i) and (ii).

wherein n is 3 and the overhead gas comprises predominantly C3 and lighter and the bottoms liquid comprises predominantly C4 and heavier.

wherein step (c) includes performing (i).

wherein step (c) includes performing (ii).

wherein step (c) includes performing both (i) and (ii).

wherein n is 4 and the overhead gas comprises predominantly C4 and lighter and the bottoms liquid comprises predominantly C5 and heavier.

wherein step (c) includes performing (i).

wherein step (c) includes performing (ii).

wherein step (c) includes performing both (i) and (ii).

wherein n is 5 and the overhead gas comprises predominantly C5 and lighter and the bottoms liquid comprises predominantly C6 and heavier.

wherein step (c) includes performing (i).

wherein step (c) includes performing (ii).

wherein step (c) includes performing both (i) and (ii).

further comprising separating the overhead vapor into heavies stream comprising predominantly Cn and heavier hydrocarbons and a lights stream comprising predominantly C(n−1) and lighter hydrocarbons and performing at least one of the following steps (i) and (ii): (i) introducing at least a portion of the heavies stream into the furnace and (ii) reacting or further separating at least a portion of the lights stream to form at least one recycled content product.

Additional Claim Supporting Description—Third Embodiment

In a third embodiment of the present technology there is provided a chemical recycling process, the process comprising: (a) pyrolyzing waste plastic to thereby produce a recycled content pyrolysis gas (r-pygas); (b) separating at least a portion of the r-pygas in a first separation vessel to thereby produce a first overhead vapor and a first r-bottoms; and (c) further separating at least a portion of at least one of the first overhead vapor and the first r-bottoms into a second overhead vapor and a second bottoms liquid in a second separation vessel.

The third embodiment described in the preceding paragraph can also include one or more of the additional aspects/features listed in the following bullet pointed paragraphs. Each of the below additional features of the third embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

wherein step (c) includes separating at least a portion of the first overhead vapor in the second separation vessel.

wherein the first overhead vapor comprises predominantly (75, 90, 95 weight percent) C1 (C2, C3, C4, C5) and lighter components.

wherein the second overhead vapor comprises predominantly (75, 90, 95 weight percent) C1 (C2, C3, C4) and lighter components.

wherein the second bottoms liquid comprises predominantly (75, 90, 95 weight percent) C2 (C3, C4, C5) and heavier components.

wherein step (c) includes separating at least a portion of the first r-bottoms in the second separation vessel.

wherein the first r-bottoms comprises predominantly (75, 90, 95 weight percent) C2 (C3, C4, C5, C6) and lighter components.

wherein the second overhead vapor comprises predominantly (75, 90, 95 weight percent) C2 (C3, C4, C5) and lighter components.

wherein the second bottoms liquid comprises predominantly (75, 90, 95 weight percent) C3 (C4, C5, C6) and heavier components.

wherein the first overhead vapor includes at least 50, 75, 90, 95 percent of the total amount of C1 (C2, C3, C4, C5) and lighter components introduced into the first separation vessel.

wherein the first r-bottoms includes at least 50, 75, 90, 95 percent of the total amount of the C2 (C3, C4, C5, C6) and heavier components introduced into the first vessel.

wherein the second overhead vapor includes at least 50, 75, 90, 95 percent of the total amount of C2 (C3, C4, C5) and lighter components introduced into the second separation vessel.

wherein the second bottoms liquid includes at least 50, 75, 90, 95 percent of the total amount of the C3 (C4, C5, C6) and heavier components introduced into the second vessel.

wherein the first vessel is a demethanizer (deethanizer, depropanizer, debutanizer, depentanizer).

wherein the second vessel is a demethanizer (deethanizer, depropanizer, debutanizer, depentanizer).

further comprising subjecting at least a portion of the second overhead vapor and/or the second bottoms liquid to further processing in one or more downstream processing zones.

wherein the processing zones include alkylation, separation, purification, and combinations thereof.

further comprising introducing at least a portion of one or more of the first overhead vapor, the first r-bottoms, the second bottoms liquid and the second overhead vapor into at least one downstream processing zone.

wherein the downstream processing zone comprises an alkylation zone, a polymerization zone, a separation zone, a purification zone, and/or a storage zone.

wherein the downstream processing zone comprises a cracking facility.

wherein the at least one of the first overhead vapor, the first r-bottoms, the second bottoms liquid and the second overhead vapor is introduced into the inlet of the cracker furnace.

wherein the at least one of the first overhead vapor, the first r-bottoms, the second bottoms liquid and the second overhead vapor is introduced downstream of the cracker furnace.

wherein the first r-bottoms further comprises predominantly C4 and heavier components and the second overhead vapor comprises predominantly C4 components.

further comprising introducing at least a portion of the second overhead vapor into an alkylation unit.

further comprising further comprising providing a recycled content C4 product stream comprising at least a portion of the second overhead vapor.

wherein the first r-bottoms further comprises predominantly C4 and heavier components and the second bottoms liquid comprises predominantly C5 and heavier components.

further comprising introducing at least a portion of the second bottoms liquid into a polymerization unit.

wherein the first overhead vapor comprises predominantly C4 and lighter components and the second bottoms liquid comprises predominantly C4 components.

further comprising introducing at least a portion of the second overhead vapor into an alkylation or separation unit.

further comprising providing a recycled content C4 product stream comprising at least a portion of the second overhead vapor.

wherein the first overhead vapor comprises predominantly C3 and lighter components and the second bottoms liquid comprises predominantly C3 components.

further comprising providing a recycled content product C3 stream comprising at least a portion of the second bottoms liquid.

Additional Claim Supporting Description—Fourth Embodiment

In a fourth embodiment of the present technology there is provided a chemical recycling process, the process comprising: (a) pyrolyzing waste plastic to thereby produce a recycled content pyrolysis gas (r-pygas); (b) separating at least a portion of the r-pygas into a first overhead stream and a first bottoms stream in a first separation vessel, wherein the first overhead stream comprises predominantly C1 (C2, C3, C4, C5) and lighter components; and (c) introducing at least a portion of the first overhead stream into a cracking furnace of a cracker facility.

The fourth embodiment described in the preceding paragraph can also include one or more of the additional aspects/features listed in the following bullet pointed paragraphs. Each of the below additional features of the fourth embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

wherein the first bottoms stream comprises predominantly C2 (C3, C4, C5, C6) and heavier components.

wherein the first bottoms stream comprises at least 75, 90, 95 weight percent C2 (C3, C4, C5, C6) and heavier components.

wherein the first overhead stream comprises at least 75, 90, 95 weight percent C1 (C2, C3, C4, C5) and lighter components.

wherein the first overhead stream comprises not more than 25 (10, 5, 1) weight percent of C2 (C3, C4, C5, C6) and heavier components.

wherein the first overhead stream comprises at least 50 (75, 90, 95) weight percent of the total amount of C1 (C2, C3, C4, C5) and lighter components introduced into the first separation vessel.

wherein the first bottoms stream comprises not more than 25 (10, 5, 1) weight percent of C1 (C2, C3, C4, C5) and lighter components.

wherein the first bottoms stream comprises at least 50 (75, 90, 95) weight percent of the total amount of C2 (C3, C4, C5, C6) and heavier components introduced into the first separation vessel.

wherein the weight ratio of the light hydrocarbon portion to the heavy hydrocarbon portion is in the range of from 0.25:1 to 25:1, 0.75:1 to 15:1, or 1:1 to 10:1.

Claims not Limited to Disclosed Embodiments

The preferred forms of the invention described above are to be used as illustration only and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A chemical recycling process, the process comprising:

(a) pyrolyzing waste plastic to thereby provide a recycled content pyrolysis gas (r-pygas);

(b) separating the r-pygas into a first recycled content portion (r-first portion) and a recycled content second portion (r-second portion);

(c) introducing at least a portion of the r-first portion into a cracking furnace of a cracker facility and combining the r-first portion with a hydrocarbon feed stream introduced into the cracker furnace and cracking the combined stream to produce a furnace effluent, wherein the hydrocarbon feed stream includes non-recycled content, and wherein the hydrocarbon feed stream includes predominantly C3 to C22 hydrocarbons; and (d) introducing at least a portion of the r-second portion into at least one location in the cracker facility downstream of the cracking furnace, wherein pyrolyzing comprises forming a pyrolysis effluent vapor, separating at least a portion of the pyrolysis effluent vapor to form the r-pygas and a recycled content pyrolysis oil (r-pyoil), and introducing at least a portion of the r-pyoil into the cracker furnace.

2. The process of claim 1, wherein the r-first portion is a predominantly C4 and heavier hydrocarbon stream and the r-second portion is a predominantly C3 and lighter hydrocarbon stream.

3. The process of claim 1, wherein the r-first portion is a predominantly C5 and heavier hydrocarbon stream and the r-second portion is a predominantly C4 and lighter hydrocarbon stream.

4. The process of claim 1, wherein the r-first portion is a predominantly C2 and heavier hydrocarbon stream and the r-second portion is a predominantly C1 and lighter hydrocarbon stream.

5. The process of claim 1, wherein the r-first portion is a predominantly C3 and heavier hydrocarbon stream and the r-second portion is a predominantly C2 and lighter hydrocarbon stream.

6. The process of claim 1, wherein the ratio of the mass flow rate of the r-second portion to the mass flow rate of the r-first portion is in the range of from 0.25:1 to 25:1.

7. The process of claim 1, further comprising introducing the r-second portion into at least one of the quench zone, the compression zone, and the separation zone of the cracking facility.

8. The process of claim 1, wherein the pyrolysis facility and the cracker facility are co-located.

9. The process of claim 1, wherein the pyrolysis facility and the cracker facility are both commercial scale.

10. A chemical recycling process, the process comprising:

(a) pyrolyzing waste plastic to thereby provide a recycled content pyrolysis gas (r-pygas), wherein pyrolyzing further comprises forming a pyrolysis effluent vapor, separating at least a portion of the pyrolysis effluent vapor to form the r-pygas and a recycled content pyrolysis oil (r-pyoil), and introducing at least a portion of the r-pyoil into the cracker furnace;

(b) separating at least a portion of the r-pyrolysis gas in at least one separation vessel to provide a recycled content overhead vapor (r-overhead) comprising predominantly Cn and lighter hydrocarbons and a recycled content bottoms liquid (r-bottoms) comprising predominantly C(n+1) and heavier hydrocarbons, wherein n is an integer between 1 and 5, inclusive; and (c) performing at least one of the following steps (i) and (ii)—

(i) introducing at least a portion of the r-bottoms into a furnace of a cracking facility;

and (ii) introducing at least a portion of the r-overhead into a location downstream of the furnace in the cracking facility.

11. The process of claim 10, wherein step (c) includes performing (i) and wherein the r-bottoms comprises predominantly C3, C4, or C5 and heavier hydrocarbons.

12. The process of claim 10, wherein the pyrolyzing includes forming a recycled content pyrolysis effluent vapor (r-pyrolysis vapor) and separating the r-pyrolysis vapor to form the r-pygas and a recycled content pyrolysis oil (r-pyoil) and further comprising introducing at least a portion of the r-pyoil into the inlet of the furnace of the cracking facility.

13. The process of claim 10, wherein the r-bottoms stream includes at least 75 weight percent of C(n+1) and heavier hydrocarbons.

14. The process of claim 10, wherein the r-overhead includes at least 75 weight percent of Cn and lighter hydrocarbons.

15. The process of claim 10, wherein step (c) includes performing (ii) and wherein the r-overhead is introduced at a location within a quench zone, a compression zone, and/or a separation zone in the cracker facility.

16. The process of claim 15, wherein the pyrolysis facility and the cracker facility are co-located and are both commercial scale.

* * * * *